United States Patent [19]

Claydon et al.

[11] Patent Number: 4,885,924

[45] Date of Patent: Dec. 12, 1989

[54] METHOD OF FORMING CONTAINERS

[75] Inventors: Paul C. Claydon, Swindon; Martin F. Ball, Shrivenham, both of England

[73] Assignee: Metal Box p.l.c., Reading, England

[21] Appl. No.: 541,346

[22] PCT Filed: Jan. 28, 1983

[86] PCT No.: PCT/GB83/00017

§ 371 Date: Sep. 26, 1983

§ 102(e) Date: Sep. 26, 1983

[87] PCT Pub. No.: WO83/02577

PCT Pub. Date: Aug. 4, 1983

[30] Foreign Application Priority Data

Feb. 2, 1982 [GB] United Kingdom ..... 8202968

[51] Int. Cl.[4] ..... B21D 51/26

[52] U.S. Cl. ..... 72/109; 72/102; 72/111

[58] Field of Search ..... 72/94, 102, 105, 106, 72/115, 110, 117, 120, 121, 124, 369, 702, 68, 93, 348, 111; 413/69, 73, 76; 220/66, 70

[56] References Cited

U.S. PATENT DOCUMENTS

| | | | |
|---|---|---|---|
| 2,170,946 | 8/1939 | Greif . | |
| 3,260,089 | 7/1966 | Hazelton et al. | 72/117 |
| 3,730,383 | 5/1973 | Dunn et al. | 220/66 |
| 3,760,751 | 9/1973 | Dunn et al. | 72/348 |
| 3,998,174 | 12/1976 | Saunders | 220/66 |
| 4,065,951 | 1/1978 | Lyu | 413/69 |
| 4,134,354 | 1/1979 | Cvacho et al. | 72/379 |
| 4,264,017 | 4/1981 | Karas et al. | 220/70 |
| 4,331,014 | 5/1982 | Miller et al. | 72/93 |
| 4,343,174 | 8/1982 | Hahn et al. | 72/348 |
| 4,389,147 | 6/1983 | Van Alsburg | 413/69 |
| 4,454,742 | 6/1984 | Gombas | 72/115 |
| 4,470,281 | 9/1984 | Kaporovich et al. | 72/68 |
| 4,646,930 | 3/1987 | Karas et al. | 72/111 |

FOREIGN PATENT DOCUMENTS

| | | | |
|---|---|---|---|
| 0005025 | 10/1979 | European Pat. Off. . | |
| 0006321 | 1/1980 | European Pat. Off. . | |
| 2440789 | 11/1979 | France . | |
| 6708023 | 12/1967 | Netherlands | 220/70 |

*Primary Examiner*—Robert L. Spruill

*Attorney, Agent, or Firm*—Burns, Doane, Swecker & Mathis

[57] ABSTRACT

In a method of reshaping a container (1) having side wall (2) and a bottom wall (3), the container is rotated by support means (11, 12) while a roll (13) is applied thereto and moved towards the container axis. The bottom wall (3) comprises a central panel (4), an annular wall (5) depending from the periphery of the central panel, an outwardly convex bead (6) of arcuate cross-section on which the container stands and a transition wall (7) extending radially and axially from the convex bead to the side wall (2), and the roll is applied to the transition wall (7) to reshape it and to tighten the curvature of the convex bead. The method permits the formation of bottom wall profiles which resist eversion under the influence of pressure within the container so that thinner metals, such as tinplate or aluminum alloys, may be used.

6 Claims, 6 Drawing Sheets

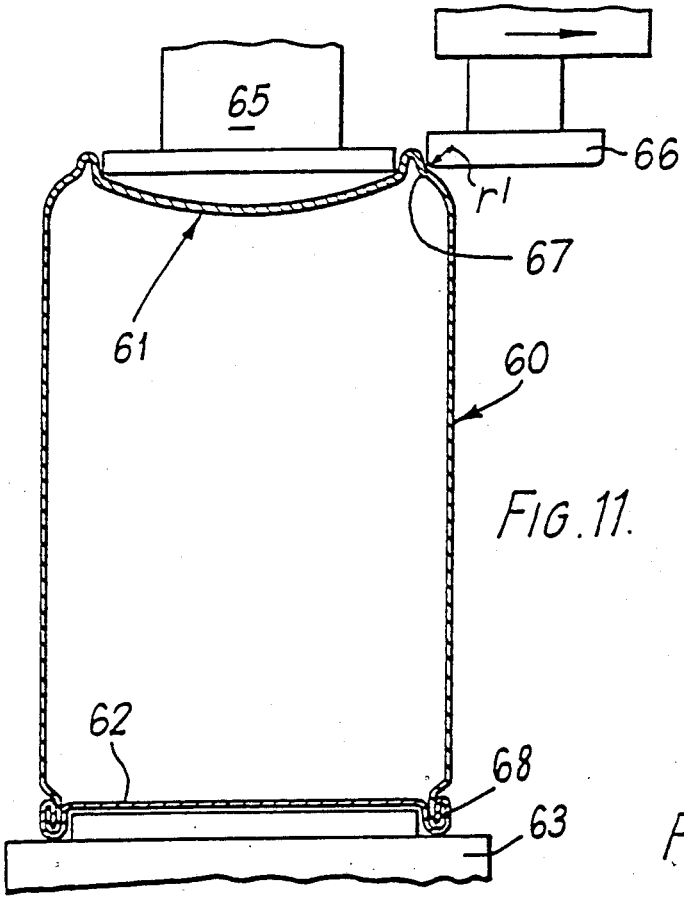
FIG. 11.
FIG. 12.
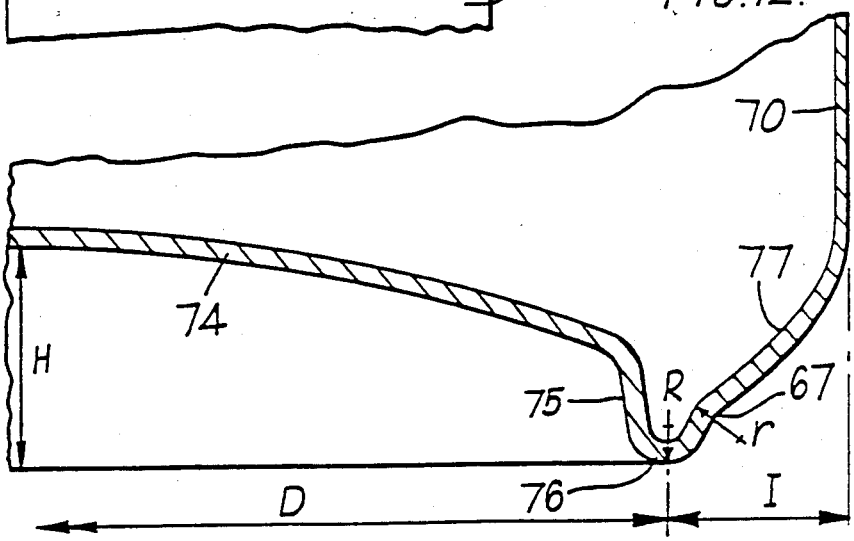

METHOD OF FORMING CONTAINERS

This invention relates to a method of forming containers, and more particularly but not exclusively to a method of reshaping a container which has been drawn from sheet metal.

U.S. Pat. No. 3,730,383 describes and claims a light weight metal container body comprising a side wall and a bottom end wall which is substantially thicker than the side wall, said bottom wall having an upwardly domed central portion therein with a substantially vertical wall section extending downward from the periphery of the domed portion to an outwardly and upwardly flaring frustoconical shoulder leading into the side wall of the container body. The bottom end wall includes small bend radii connecting the vertical wall section to the central domed portion and to the flaring shoulder. A further bend radius connects the flaring shoulder to the side wall. The thinner side wall extends a substantial distance within the flaring shoulder. Such prior art cans are made from aluminium alloy and are wall ironed to create the relatively thin side wall and a thick bottom having a hollow central portion. The interior of the cans is coated with a protective coating and the bottom end wall is pressed to final shape between a punch engaging the external surface of the hollow portion of the bottom end and a hollow die entered in the can to support an annulus of bottom end material around the hollow portion so that co-operation of the punch and die pulled the end material to conform to the punch and die profiles and create a bottom end wall having a domed portion supported by the vertical wall section.

However it is in the nature of materials such as tinplate and certain aluminium alloys to springback after cold work so that even if the punch and die are close fitting on the metal the so-called "vertical" wall of the bottom end wall will not be vertical when it is removed from the tools and the structural benefit of the wall being vertical or nearly vertical is not practically and reliably achieved.

Furthermore, it is current practice to draw a bottom wall with an open profile to permit the spraying of lacquer onto the internal surfaces of the container. If the punch and die used to reform the bottom wall are a tight fit on the metal to obtain as upright a wall as possible, there is a risk that the internal lacquer may be damaged by abrasion.

The resistance of the bottom wall to flexure is also dependent upon the radius of the outwardly convex bead on which the container stands. The production of the vertical annular wall in conjunction with a small radius stand bead is limited by the nature of the forming operation by which a bead of this type is produced between a punch and die.

To produce a bead of small radius, the convex radius of the nose of the punch is limited to that which will not penetrate the container material during forming. A profile requiring a small radius in conjunction with a steep annular wall will give rise to a tool section of insufficient strength to support the stresses imparted to the punch during the forming operation.

An object of the present invention is to provide a method of reshaping a container in which the problems described above are reduced.

According to the invention there is provided a method of reshaping a container having a side wall and a bottom wall, the side wall extending substantially axially to a free edge defining a mouth of the container, the bottom wall comprising a central panel around which a hollow support surface for the container extends, the hollow support surface being incorporated in a transitional portion connecting the periphery of the central panel to the side wall, characterised in that the method comprises the steps of applying first support means to the mouth of the container and second support means to the bottom wall of the container, and applying a roll to the transitional portion of the bottom wall, the second support means and the roll being arranged such that at least a part of the transitional portion is therebetween, and causing relative displacement of the roll and the second support means towards one another and relative rolling motion between the roll and the container to thereby decrease the lateral extent of said hollow support surface and reshape the transitional portion of the bottom wall.

In an embodiment, the support means are rotated to rotate the container about its longitudinal axis while the roll is applied to the transitional portion. Alternatively the container body may be held stationary and the work roll is moved around it.

In one embodiment, the side wall of the container is cylindrical and the transitional portion comprises an annular wall depending from the periphery of the central panel, an outwardly convex bead defining the support surface, and a transition wall extending radially and axially from the convex bead to the side wall.

It has been found that this invention permits the formation of a vertical annular wall in conjunction with an outwardly convex bead which is smaller in radius than that which can be produced by punch and die methods.

Preferably, said second support means are applied to the bottom wall within the support surface and the roll is applied to the laterally exterior surface of the transitional portion, and in the roll is moved towards the second support means and thus towards the container axis to reshape the transitional portion.

Preferably, the transition wall is frustoconical and the roll may have a substantially frustoconical work surface the included cone angle of which is greater than that of the transition wall so that movement of the roll towards the second support means increases the cone angle of the transition wall and tightens the curvature of the convex bead. This reshaping of the transition wall and the convex bead may move the annular wall to extend at an inclination to the container axis in the range of plug 5° to minus 5°. The convex bead may be tightened in curvature as measured at the exterior surface of the bead to a radius in the range of 0.005 to 0.050 inches, (0.127–1.27 mm).

In an embodiment, the transition wall is of arcuate cross section and the roll has a profiled work surface so that relative displacement of the roll towards the second support means reshapes the transition wall and tightens the curvature of the convex bead.

The reshaping of the bottom wall of the container creates a shape better able to resist flexure of the bottom wall under the influence of pressures within the container. It is therefore possible either to use the strengthened end wall to contain higher internal pressures or alternatively to use thinner metal and still achieve bottom wall performance equivalent to that achieved by prior art methods.

The present invention also extends to a container having a side wall and a bottom wall, the side wall extending substantially axially to a free edge defining a mouth of the container, characterised in that the bottom wall has been reshaped by a method according to any preceding claim to comprise a central panel around which a hollow support surface extends, the hollow support surface being incorporated in a transitional portion connecting the periphery of the central panel to the side wall.

Embodiments of the present invention will now be described by way of example and with reference to the accompanying drawings in which:

FIG. 11 shows a further embodiment of reshaping apparatus and a further embodiment of a container body after reshaping; and FIG. 12 shows an enlarged fragmentary section of the reshaped bottom wall of the container body shown in FIG. 11.

Figure 1:
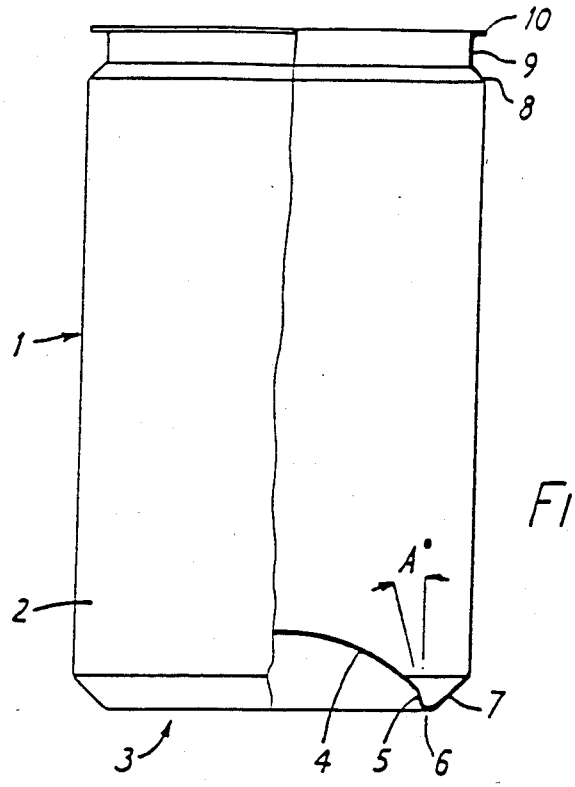
FIG. 1 is a side view of a container shown half in section before re-shaping.

FIG. 1 shows a container body 1 drawn from a sheet of aluminium alloy and subsequently redrawn and wall ironed to have a side wall 2 thinner than a bottom wall 3. The bottom wall 3 comprises a central panel 4 around which a hollow support surface 6 extends, the support surface 6 being incorporated in a transitional portion 5,6,7, connecting the periphery of the central panel 4 to the side wall 2. In the container shown in FIG. 1 the transitional portion consists of an annular wall 5 extending from the periphery of the central panel 4 to an outwardly convex bead 6 of arcuate cross section on which the container body may stand, and a transition wall 7 extending from the outer periphery of the convex bead 6 to the side wall 2. The side wall extends axially from the bottom wall to a shoulder 8, neck 9, and flange 10 which define the mouth of the container. Typically the overall diameter of the body is 2.59", (65.79 mm).

Figure 2:
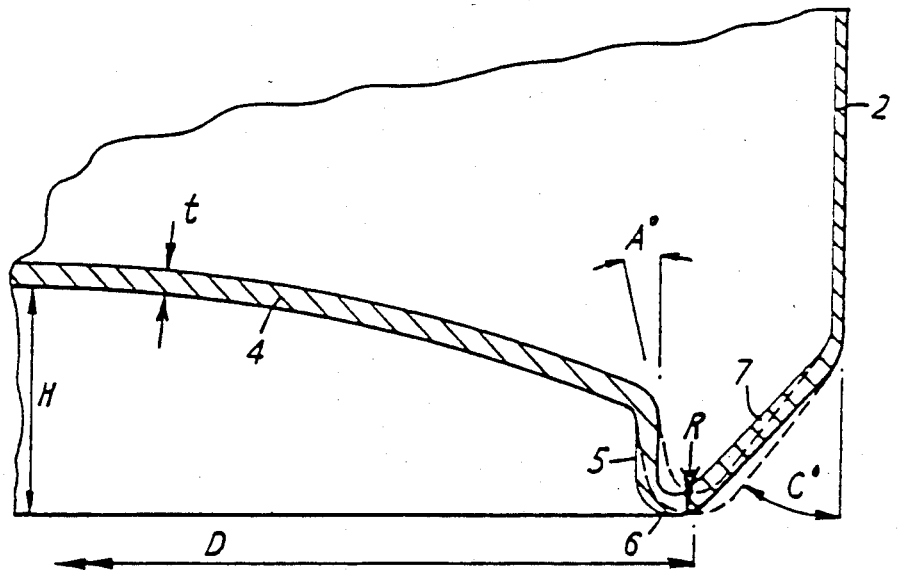
FIG. 2 is an enlarged fragmentary section showing the reshaped bottom wall in full lines and the container shape before reshaping in broken lines.

FIG. 2 shows on an enlarged scale a section of a fragment of the container body 1, and in the drawing the broken lines show the bottom wall profile before reshaping, and the full lines show the bottom wall profile after one possible reshaping operation. In FIG. 2 the side wall 2 is parallel to the cylinder axis of the container body 1. The transition wall 7 is frustoconical and extends axially and inwardly from the side wall 2 to join the convex bead 6. The wall 7 extends a distance (measured along the axis) of approximately 0.261" (66.04 mm) at an angle denoted "C°" The convex bead 6 has an external radius of curvature denoted "R". The annular wall 5 extends axially inwards from the inner periphery of the bead 6 at an angle denoted A° to a vertical line parallel to the cylinder axis of the container. The central panel 4 is in the form of a dome of spherical radius approximately 2.0" (50.8 mm) which spans the annular wall 5. The thickness of the metal of the dome is denoted "t" and the height of the centre of the dome above the extremity of the convex bead 6 is denoted "H". The diameter of the convex bead is denoted "D" and is measured across the extremities as indicated and is initially about 2.15", (54.61 mm).

Figure 3:
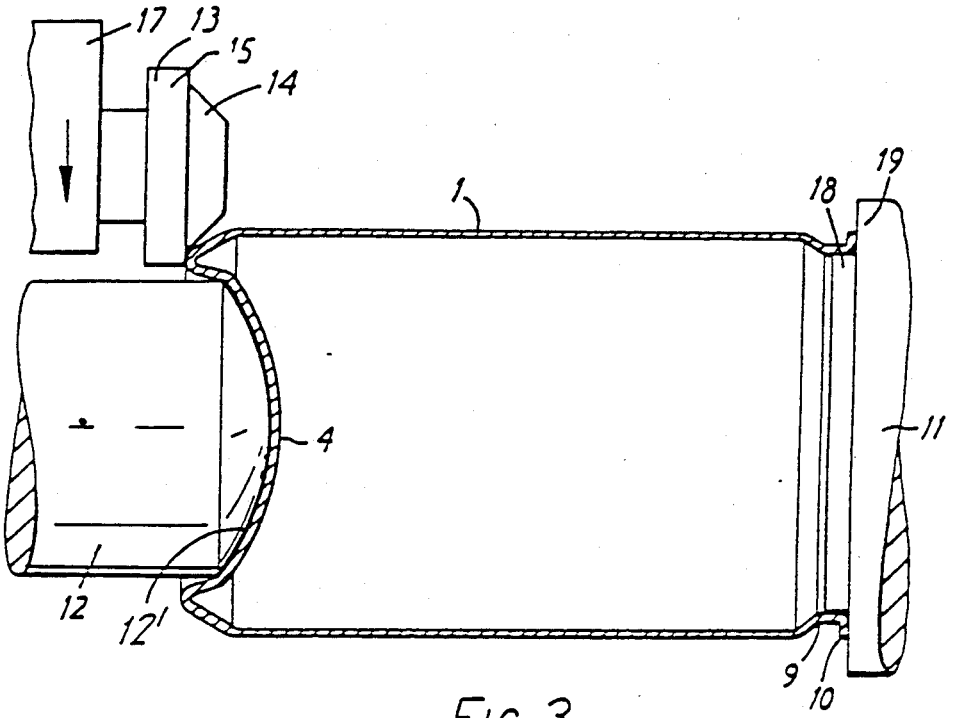
FIG. 3 is a diagrammatic view of apparatus for reshaping a container showing the container body in section before reshaping thereof.

FIG. 3 shows apparatus for reshaping the container body 1. The apparatus comprises a first support means in the form of a rotatable pad 11, a second support means in the form of a domed chuck 12 which is similarly driven to rotate, and a freely rotatable work roll 13 mounted for movement towards the domed chuck 12. In FIG. 3 a container body 1 is supported between the domed chuck 12 and the pad 11 which are rotated such that the container body is rotated about its longitudinal axis.

The rotating pad 11 comprises a plug portion 18 entered into the neck 9 of the container body 1, and a flange portion 19 engaged with the flange 10 of the container body 1. The plug portion 18 fits within the neck portion 9 to ensure centreing of the container body during rotation but not so tightly as to cause abrasive damage to the internal lacquer on the container body 1.

The domed chuck 12 has a dome surface 12' having a curvature which conforms to the curvature of the central panel 4 so that the forces of rotation are delivered over the whole area of the central panel 4. A steel domed chuck has been found adequate but materials having a higher coefficient of friction may be used if desired: for example a rubber driving surface may be used.

The work roll 13 is mounted for rotation on a mounting 17 which is movable towards and away from the domed chuck 12 so that the work roll may be retracted after reshaping to permit removal of the reshaped container.

The work roll 13 has a generally frustoconical work surface 14 the included cone angle of which is greater than that of the transition wall 7 of the container body 1. The work roll 13 has a limit ring 15 extending beyond the work surface.

To reshape the bottom wall of the container body 1, the work roll 13 is moved radially with respect to the longitudinal axis of the container body 1 towards the domed chuck 12 whilst the container body 1 is being rotated. The work roll surface 14 thus comes into contact with the transition wall 7 and reshapes the wall 7, the convex bead 6, and the annular wall 5 by compression of the transitional portion between the work surface 14 of the roll 13 and, the cylindrical portion 16 of the domed chuck 12. The end position of the work roll 13 is illustrated in FIG. 4 in which the reshaped container is also shown.

Figure 4:
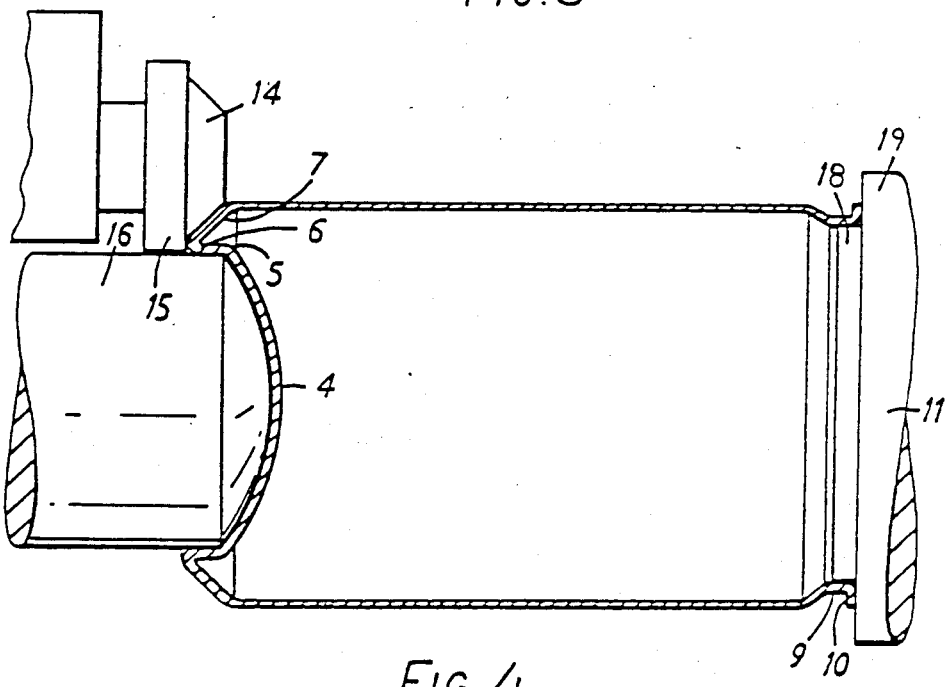
FIG. 4 is a like view of FIG. 3 after the bottom wall of the container body has been reshaped.

In the embodiment illustrated in FIG. 4, the bottom wall has been reshaped such that the annular wall 5 extends parallel to the longitudinal axis of the container body 1. If it is desired to push the annular wall 5 further inwardly than the position shown in FIG. 4 such that it extends at an angle to the longitudinal axis, the cylindrical portion 16 is recessed slightly. However, any recess in the cylindrical portion 16 must not be excessively deep otherwise it will be impossible to remove the finished container from the domed chuck 12. An incination to the axis of between +5° and −5° is practicable and gives rise to useful containers.

During the application of the work roll 13 to the transition wall 7 the inclination of the transition wall to the container axis is increased as it conforms to the work surface 14 of the roll 13. Also the internal radius of curvature of the convex bead is reduced. By provision of a suitably dimensioned work roll the internal radius of curvature may be reduced to zero, represented by a fold line. However, for practical purposes the external radius of curvature R is controlled to have a value within the range of 0.005 to 0.040 inches, (0.127–1.016 mm).

It is believed that an increase in the pressure within a container body 1 such as is as described with reference to FIGS. 1 to 4, causes the domed central panel 4 and the annular wall 5 to move axially and thereby cause a peripheral zone of metal of the annular wall to flow around the convex bead to distend the transition wall 7 until eversion finally takes place when the annular wall metal is no longer adequate to act as a hoop to contain the forces delivered by the domed central panel. Therefore it is believed that in the reshaped bottom wall produced as shown in FIGS. 3 and 4 each altered parameter contributes to the strength thereof. Thus, the tightened external surface radius "R" impedes distention; the controlled inclination of the annular wall impedes flow into the bead; and the increased inclination of the transition wall 7 to the container axis brings about a reduction in the diameter of the convex bead so reducing the area on which the internal pressure acts.

The following table records three examples of the results obtained when reshaping can bodies drawn from a disc of aluminium alloy, No. 3004 (1 to 1.5% Mn, 0.8 to 1.3% Mg bal. %Al), in the H 19 temper condition.

The method of reshaping may also be used to improve the performance of cans for processed foods which do not have to contain the high pressures associated with carbonated beverages.

Figure 5:
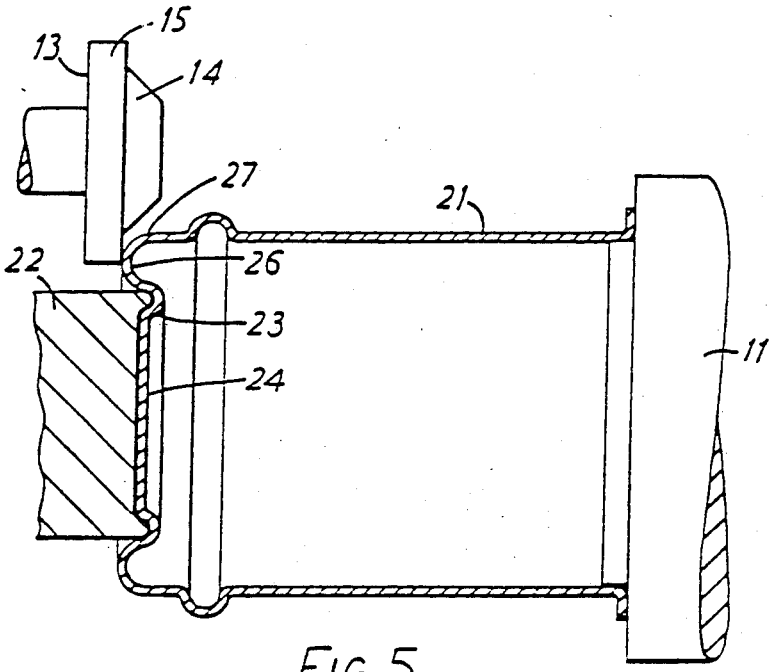
FIG. 5 is a diagrammatic view of apparatus for reshaping a container showing a second container body in section before reshaping.

In FIG. 5 a can body 21 is shown in apparatus having a suitably shaped chuck 22 shortly before reshaping. The bottom wall of the can body 21 comprises a flat central panel 24 surrounded by a transitional portion which consists of an inwardly convex annulus 23 of arcuate cross section which connects the central panel to a peripheral outwardly convex bead 26 connecting with the side wall of the can body 21. The convex bead 26 has an exterior transitional surface 27 against which the work surface 14 of roll 13 is applied.

Figure 6:
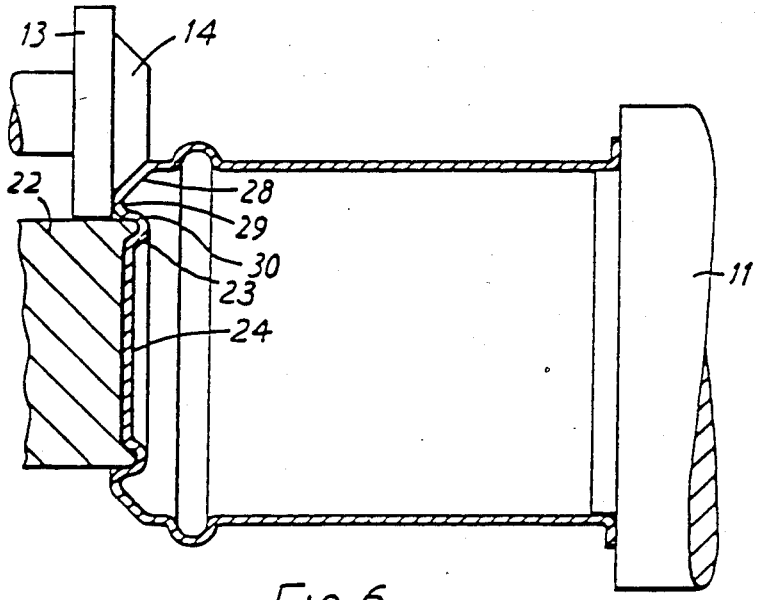
FIG. 6 is a like view to FIG. 5 after reshaping of the container body.

In FIG. 6 the work roll 13 has been applied to the exterior surface 27 of the peripheral outwardly concave bead 26 to reshape the convex bead to have a frustoconical outer surface 28 extending to a tight convex bead 29 on which the can may stand. During reshaping an annular portion 30 is formed which supports the annulus 23 so that the inherently flexible central panel is supported by stiffened reshaped portions, and the container side wall is supported by a stiffened, tight radius "stand" bead connecting with the frustoconical exterior surface.

Figure 7:
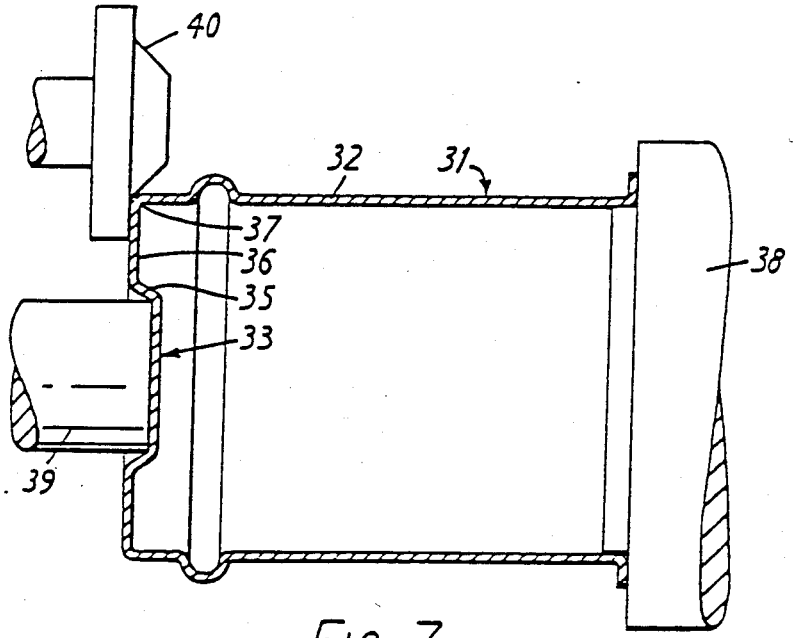
FIG. 7 is a diagrammatic view of reshaping apparatus before reshaping of a can body shown in section.

In FIG. 7 a can body 31, drawn from a sheet metal blank, has a side wall 32 and a bottom wall 33. The bottom wall comprises a central panel 34 around which a transitional portion extends and connects the periphery of the central panel 34 to the side wall 32. The transitional portion consists of an annular wall 35 extending axially and radially outwards to a small bend portion which connects with a planar portion 36 surrounded by a transition 37 which connects with the side wall 32. The planar portion 36, transition 37 and small bend portion joining the planar portion to the annular wall 35 constitute a hollow support surface on which

| | A° INCLINATION OF CYLINDER WALL | C° INCLINATION OF PERIPHERAL FRUSTO-CONE | "R" BEAD RADIUS IN INCHES (mm) | CHANGE IN "D" BEAD DIAMETER IN INCHES (mm) | H DOME HEIGHT IN INCHES (mm) | t DOME GAUGE .0001" (mm) | DOME REVERSAL PRESSURE lbs/sq. in (kPa) |
|---|---|---|---|---|---|---|---|
| CAN BODY 1 | | | | | | | |
| Before reshaping | 9 | 40 | .056 (1.42) | D | .362 (9.19) | 125 (0.32) | 86 (593) |
| After reshaping | 5 | 49 | .030 (0.75) | D-.048 (1.22) | .363 (9.19) | 125 (0.32) | 100 (689.5) |
| CAN BODY 2 | | | | | | | |
| Before reshaping | 2 | 46 | .060 (1.52) | $D^1$ | .388 (9.85) | 125 (0.32) | 91 (647) |
| After reshaping | 2 | 53 | .033 (0.832) | $D^1$-.040 (1.02) | .387 (9.83) | 125 (0.32) | 97 (689) |
| CAN BODY 3 | | | | | | | |
| Before reshaping | 10 | 41 | .054 (1.37) | $D^2$ | .400 (10.16) | 116 (0.295) | 72 (496) |
| After reshaping | 4 | 49½ | .028 (0.71) | $D^2$-.048 (1.22) | .398 (10.12) | 116 (0.295) | 82 (565) |

The right hand column of the table shows that in each example the internal pressure at which the dome everted or reversed in shape was significantly greater after reshaping. This means that the reshaped profile was strengthened without costly addition to the metal thickness. If however the original reversal pressure is adequate for any particular product, such as a less carbonated beverage, then a thinner starting disc may be used to create the reshaped profiles so saving metal.

the can may stand. The mouth of the can is defined by a flange.

The can body 31 is supported for rotation about its longitudinal axis by means of a rotatable pad 38 engaged with the mouth of the can and a chuck 39 engaged with the central panel 34.

Figure 8:
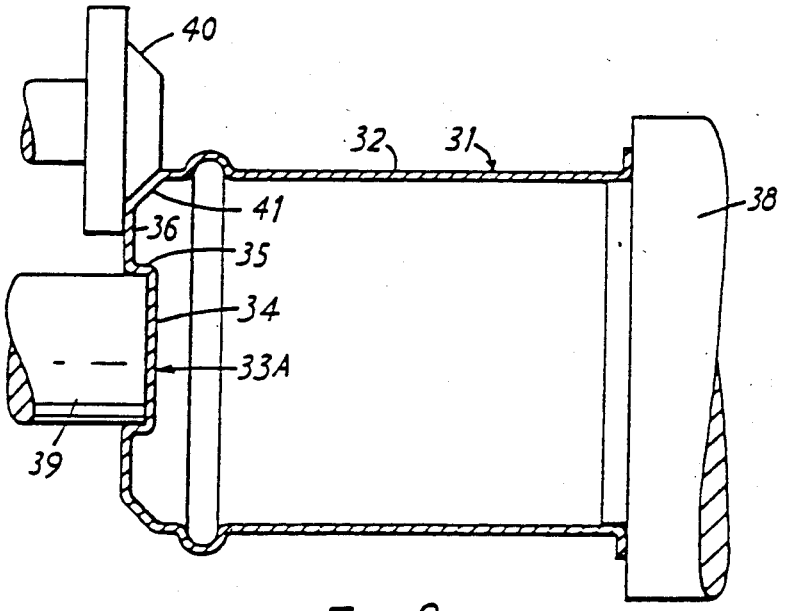
FIG. 8 is a like view to FIG. 7 after reshaping of the can body.

As the can body 31 is rotated about its axis, a work roll 40 is moved to bring its work surface to bear upon the transition 37 of the can so that continued movement of the work roll towards the chuck 39 reshapes the transition 37 of FIG. 7 to a frustoconical wall 41 as shown in FIG. 8. Simultaneously the inclination of the annular wall 35 to the axis of the can body is decreased as the small bend portion is bent to a tighter radius. The reshaped end wall 33A illustrated in FIG. 8 is suitable for cans subjected to thermal processing after filling.

In the embodiments described above the chuck is shaped to conform to the finished shape of a part of the bottom wall of the container body. Thus, it will be seen from FIGS. 3 and 4 that the surface 12' of the domed chuck 12 conforms to the curvature of the central panel 4, whilst in the embodiment of FIGS. 5 and 6 the surface of the chuck 22 conforms to the final shape of the central panel 24 and the annular portion 30.

It has been found that many shapes can be formed without it being necessary to conform the surface of the chuck to the finished shape of the bottom wall. For example, in the embodiment illustrated in FIGS. 3 and 4 the reshaping is carried out by the work surface 14 of the roll 13 and by the cylindrical portion 16 of the chuck 12. Accordingly, instead of having the domed surface 12', the chuck 12 could have a planar surface spaced from the central panel 4.

In some instances, for example, when operating over long periods of time such that the work roll and chuck reach high operating temperatures, there may be a tendency for the reshaped container body to stick to the chuck. This is less noticeable when the end of the chuck is spaced from the finished container body as suggested above, but even so, it may be desirable to include in the apparatus a knock-pad to eject the reformed container from the chuck.

Figure 9:
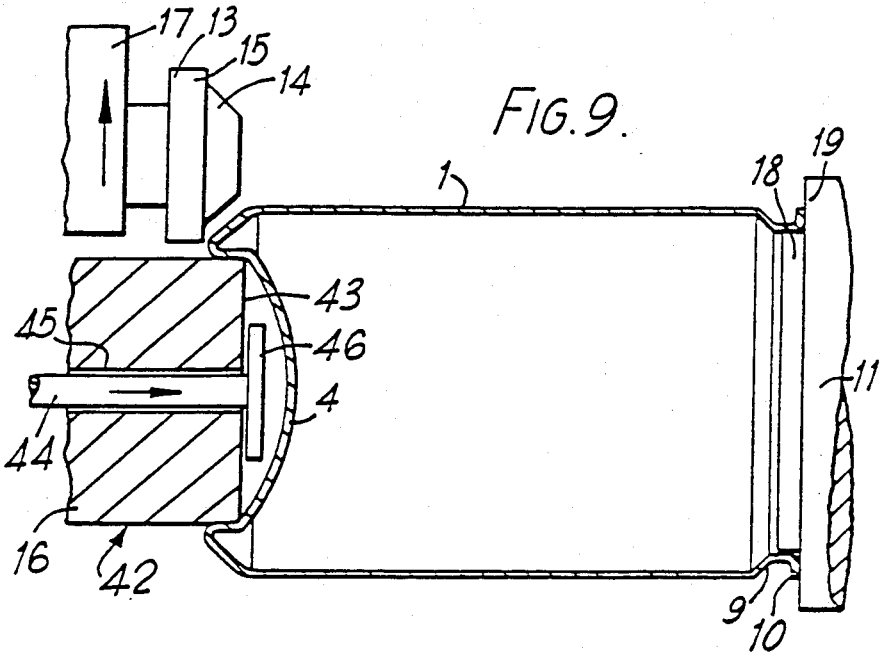
FIG. 9 is a diagrammatic view of a further embodiment of reshaping apparatus shown after the reshaping operation.

An embodiment of apparatus including a knock-out pad is shown in FIG. 9. It will be appreciated that in many respects the apparatus of FIG. 9, which is illustrated at the completion of a reshaping operation on the container body 1, is the same as the apparatus of FIGS. 3 and 4 and like parts have been accorded the same reference numerals. The chuck 42 has a cylindrical portion 16 and a planar end surface 43 spaced from the central panel 4. A push rod 44 is arranged to extend through an axial bore 45 of the chuck 42 and carries at one end a knock-out pad 46. The other end of the push rod 44 is connected to conventional means (not shown) for displacing the rod 44 towards the container body 1 after completion of the reforming operation to eject the body 1 from the chuck 42.

A knock-out pad can be provided for any of the profiles of the bottom wall described and illustrated herein. However, a knock-out pad is a necessity if the reshaped container bottom wall encloses the chuck, for example, as in the embodiment shown in FIG. 10. The apparatus of FIG. 10, which is illustrated at the completion of a reshaping operation, is similar to that of FIG. 9. However, it will be seen that the chuck 52 has a planar end surface 53 whose diameter is greater than that of the cylindrical portion 16 such that a divergent surface 54 is defined. Thus, in reforming of the container body 1 the annular wall 5 is pushed against the surface 54 such that it extends inwardly at an angle to the longitudinal axis of the container body. As the annular wall 5 thus encloses the chuck 52, the knock-pad 46 is necessary to remove the container body 1 from the chuck.

Figure 10:
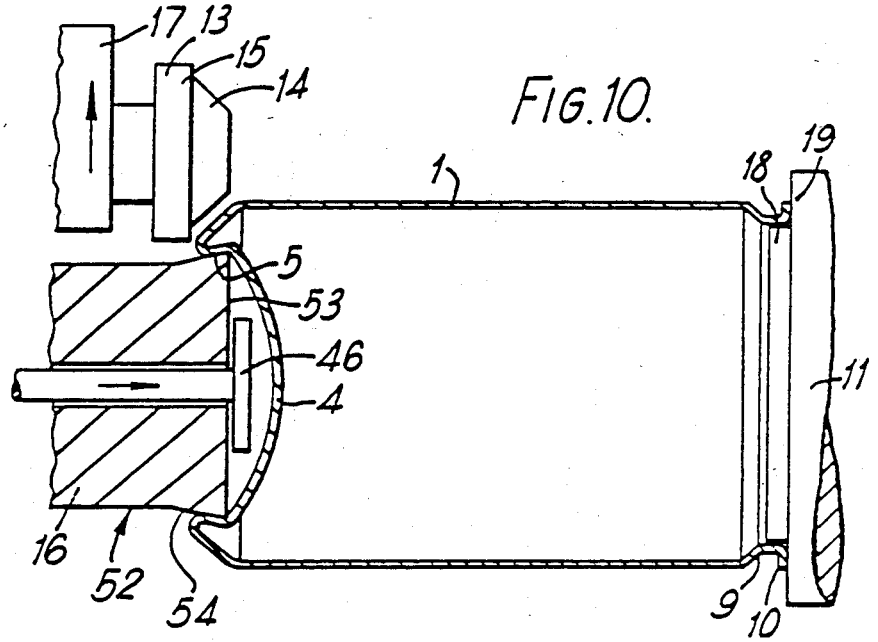
FIG. 10 shows a still further embodiment of reshaping apparatus after the reshaping operation.

The arrangement shown in FIG. 10 can be used to provide the profile illustrated therein which includes a re-entrant dome. Alternatively, this apparatus provides, for materials with spring back, a method of ensuring that the annular wall 5 extends substantially parallel to the longitudinal axis of the container body in the finished container. Thus, in this case, the annular wall 5 would be reformed to extend inwardly at a small angle to the longitudinal axis, for example, up to 5° such that spring back would bring the annular wall substantially parallel to the longitudinal axis.

In the embodiments described above work rolls having a substantially frustoconical work surface are used, but other profiles of work surface may be used if desired. For example, the work surface may be arcuate or of an exponential character.

FIG. 11 shows apparatus for reshaping the bottom wall 61 of a can body 60. In this embodiment the can body 60 has been filled and a lid 62 affixed thereto before the reshaping of the bottom wall 61. The filled can is supported upside down on a rotatable table 63 engaged with the lid 62 and a chuck 65 is brough into contact with the bottom wall 61. The reshaping of the transitional portion between the central panel of the bottom wall 61 and the side wall of the can body is performed using a roll 66. In this embodiment, the roll 66 has a cylindrical work surface with a radiussed edge r' which is arranged to form a concavity 67 in the exterior surface of the transitional portion of the bottom wall 61.

In FIG. 11 the can is shown to be filled and to be supported such that its axis extends vertically during the reshaping operation. Of course, it could be reshaped before filling and/or with its longitudinal axis extending horizontally. Similarly, the other embodiments of the apparatus illustrated can be used to reshape filled containers and it is a matter of choice whether the container bodies are supported such that their longitudinal axes extend vertically, horizontally, or indeed at an inclination, during the reforming operation.

The can body 60 illustrated in FIG. 11 has a bottom wall 61 which has been reformed into a shape which is particularly designed to enable filled cans to be reliably stacked. An enlarged section of a fragment of the can body 60 is shown in FIG. 12. The can body 60 has been formed by drawing and wall ironing to have a side wall 70 thinner than the bottom wall 61. The bottom wall comprises a central domed panel 74 around which a hollow support surface 76 extends, the support surface 76 being incorporated in the transitional portion 75, 76, 77 connecting the periphery of the central panel 74 to the side wall 70. In the embodiment shown in FIGS. 11 and 12, the transitional portion consists of an annular wall 75 extending from the periphery of the central panel 74 to an outwardly convex bead 76 of arcuate cross-section forming the support surface on which the can body may stand, and a transition wall 77 extending from the outer periphery of the convex bead 76 to the side wall 70. The concavity 67 is formed in the transition wall 77.

The transition wall 77 extends axially and inwardly from the side wall 70 to join the convex bead 76. The wall 77 extends inwardly a distance I of approximately 0.524" (13.31 mm). The convex bead 76 has an external radius of curvature R which is about 0.041" (1.04 mm). The central panel 74 is in the form of a dome whose centre reaches a height H above the extremity of the convex bead 76 which is of the order of 0.396" (10.06 mm). The diameter D of the convex bead 76 is measured across its extremities as indicated and is initially about 2.074" (52.68 mm).

The bottom wall shape illustrated in FIGS. 11 and 12 enables filled cans to be reliably stacked. Thus, the distance I between the convex bead 76 and the external diameter of the side wall 70 is sufficiently large such that the beads 76 can be engaged in a lid 62 of a further can within the double seam 68 produced when fixing the lid 62 to the can body. In addition, the double seam 68 is arranged to nest in the concavity 67. The concavity 67 has a radius of curvature r in the region of 0.030"–0.075" (0.76–1.90 mm), and in the embodiment illustrated is about 0.076" (1.78 mm). To achieve this the radius of curvature of the radiussed edge r' of the roll 66 is preferably of the order of 0.020"–0.050" (0.51–1.27 mm).

Whilst the method has been described in terms of containers made from aluminium alloys the method may be applied to container materials such as tinplate, aluminium and aluminium alloys.

We claim:

1. A method for reshaping a bottom wall of a container having a side wall and said bottom wall, the side wall extending substantially axially to a free edge defining a mouth of the container, and the bottom wall comprising a preformed central panel, an annular wall extending from the periphery of the central panel, and an outwardly convex portion defining an annular support surface for the container, said outwardly convex portion joining the annular wall to said side wall and including a transitional portion integral with said side wall, said method comprising the steps of applying first support means to the mouth of the container and second support means to the central panel of said bottom wall, applying a roll to the transitional portion of the container, and moving the roll towards the container axis so that relative rolling motion between the roll and the container reshapes the transitional portion and tightens the curvature of the convex portion.

2. A method according to claim 1 wherein the container is rotated about its longitudinal axis while the roll is applied to the transitional portion.

3. A method according to claim 2, wherein the side wall of the container is cylindrical, said transitional portion extends radially and axially from the convex portion to the side wall, and wherein the roll is applied to the transitional portion.

4. A method according to claim 2, wherein said transitional portion is frustoconical, and wherein the roll has a substantially frustoconical work surface the included cone angle of which is greater than the included cone angle of the transitional portion so that the displacement of the roll towards the container axis increases the cone angle of the transitional portion.

5. A method according to claim 2, wherein the movement of the roll towards the container axis moves the annular wall to extend at an angle to the container axis within the range of plus 5° to minus 5°.

6. A method according to claim 2, wherein the convex portion is reduced in curvature to have a radius, as measured at the exterior surface of said convex portion, in the range of 0.005 to 0.050 inches (0.127 to 1.27 mm).

* * * * *